US008083484B2

(12) United States Patent
Hatman

(10) Patent No.: US 8,083,484 B2
(45) Date of Patent: Dec. 27, 2011

(54) TURBINE ROTOR BLADE TIPS THAT DISCOURAGE CROSS-FLOW

(75) Inventor: Anca Hatman, Easley, SC (US)

(73) Assignee: General Electric Company, Schenectady, NY (US)

( * ) Notice: Subject to any disclaimer, the term of this patent is extended or adjusted under 35 U.S.C. 154(b) by 489 days.

(21) Appl. No.: 12/344,293

(22) Filed: Dec. 26, 2008

(65) Prior Publication Data

US 2010/0166566 A1 Jul. 1, 2010

(51) Int. Cl.

| | |
|---|---|
| ***B64C 11/24*** | (2006.01) |
| ***F01D 5/18*** | (2006.01) |
| ***F03B 3/12*** | (2006.01) |
| ***F03D 11/02*** | (2006.01) |
| ***F04D 29/38*** | (2006.01) |

(52) U.S. Cl. ..... 416/92; 416/223 A; 416/228; 415/173.1

(58) Field of Classification Search ..... 416/92, 416/228, 223 A; 415/173.1

See application file for complete search history.

(56) References Cited

U.S. PATENT DOCUMENTS 4,411,597 A * 10/1983 Koffel et al. ..... 416/92
2002/0119045 A1* 8/2002 Starkweather ..... 416/97 R
2002/0119047 A1* 8/2002 Starkweather ..... 416/97 R
2003/0059304 A1* 3/2003 Leeke et al. ..... 416/97 R
2006/0062671 A1* 3/2006 Lee et al. ..... 416/92

FOREIGN PATENT DOCUMENTS

GB 2155558 A * 9/1985

* cited by examiner

*Primary Examiner* — Michelle Estrada

(74) *Attorney, Agent, or Firm* — Mark E. Henderson; Ernest G. Cusick; Frank A. Landgraff

(57) ABSTRACT

A turbine rotor blade for a gas turbine engine including an airfoil and dovetail for mounting the airfoil along a radial axis to a rotor disk inboard of a turbine shroud, the airfoil comprising: a pressure sidewall and a suction sidewall that join together at a leading edge and a trailing edge, the pressure sidewall and suction sidewall extending from a root to a tip plate; a pressure tip wall that extends radially outwardly from the tip plate, traversing from the leading edge to the trailing edge such that the pressure tip wall resides approximately adjacent to the termination of the pressure sidewall; a suction tip wall that extends radially outwardly from the tip plate, traversing from the leading edge to the trailing edge such that the suction tip wall resides approximately adjacent to the termination of the suction sidewall; and one or more tip ribs that extend substantially between the pressure tip wall and the suction tip wall.

19 Claims, 2 Drawing Sheets

TURBINE ROTOR BLADE TIPS THAT DISCOURAGE CROSS-FLOW

BACKGROUND OF THE INVENTION

The present application relates generally to apparatus, methods and/or systems for discouraging cross-flow over turbine airfoil tips. More specifically, but not by way of limitation, the present application relates to apparatus, methods and/or systems related to turbine blade tips that include a squealer tip and/or cross ridges or ribs that discourage cross-flow the blade.

In a gas turbine engine, it is well known that air is pressurized in a compressor and used to combust a fuel in a combustor to generate a flow of hot combustion gases, whereupon such gases flow downstream through one or more turbines so that energy can be extracted therefrom. In accordance with such a turbine, generally, rows of circumferentially spaced rotor blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail.

The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Maximum efficiency of the engine is obtained by minimizing the tip clearance or gap such that leakage is prevented, but this strategy is limited somewhat by the different thermal and mechanical expansion and contraction rates between the rotor blades and the turbine shroud and the motivation to avoid an undesirable scenario of having the tip rub against the shroud during operation.

In addition, because turbine blades are bathed in hot combustion gases, effective cooling is required for ensuring a useful part life. Typically, the blade airfoils are hollow and disposed in flow communication with the compressor so that a portion of pressurized air bled therefrom is received for use in cooling the airfoils. Airfoil cooling is quite sophisticated and may be employed using various forms of internal cooling channels and features, as well as cooling holes through the outer walls of the airfoil for discharging the cooling air. Nevertheless, airfoil tips are particularly difficult to cool since they are located directly adjacent to the turbine shroud and are heated by the hot combustion gases that flow through the tip gap. Accordingly, a portion of the air channeled inside the airfoil of the blade is typically discharged through the tip for the cooling thereof.

It will be appreciated that conventional blade tip design includes several different geometries and configurations that are meant prevent leakage and increase cooling effectiveness. Exemplary patents include: U.S. Pat. No. 5,261,789 to Butts et al.; U.S. Pat. No. 6,179,556 to Bunker; U.S. Pat. No. 6,190,129 to Mayer et al.; and, U.S. Pat. No. 6,059,530 to Lee. Conventional blade tip designs, however, all have certain shortcomings, including a general failure to adequately reduce leakage and/or allow for efficient tip cooling that minimizes the use of efficiency-robbing compressor bypass air. Improvement in the pressure distribution near the tip region is still sought to further reduce the overall tip leakage flow and thereby increase turbine efficiency. As a result, a turbine blade tip design that alters the pressure distribution near the tip region and otherwise reduces the overall tip leakage flow, thereby increasing the overall efficiency of the turbine engine, would be in great demand. Further, it is also desirable for such a blade tip to enhance the cooling characteristics of the cooling air that is released at the blade tip, as well as, enhancing the overall aerodynamic performance of the turbine blade.

BRIEF DESCRIPTION OF THE INVENTION

The present application thus describes a turbine rotor blade for a gas turbine engine including an airfoil and dovetail for mounting the airfoil along a radial axis to a rotor disk inboard of a turbine shroud, the airfoil comprising: a pressure sidewall and a suction sidewall that join together at a leading edge and a trailing edge, the pressure sidewall and suction sidewall extending from a root to a tip plate; a pressure tip wall that extends radially outwardly from the tip plate, traversing from the leading edge to the trailing edge such that the pressure tip wall resides approximately adjacent to the termination of the pressure sidewall; a suction tip wall that extends radially outwardly from the tip plate, traversing from the leading edge to the trailing edge such that the suction tip wall resides approximately adjacent to the termination of the suction sidewall; and one or more tip ribs that extend substantially between the pressure tip wall and the suction tip wall.

These and other features of the present application will become apparent upon review of the following detailed description of the preferred embodiments when taken in conjunction with the drawings and the appended claims.

BRIEF DESCRIPTION OF THE DRAWINGS

These and other objects and advantages of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
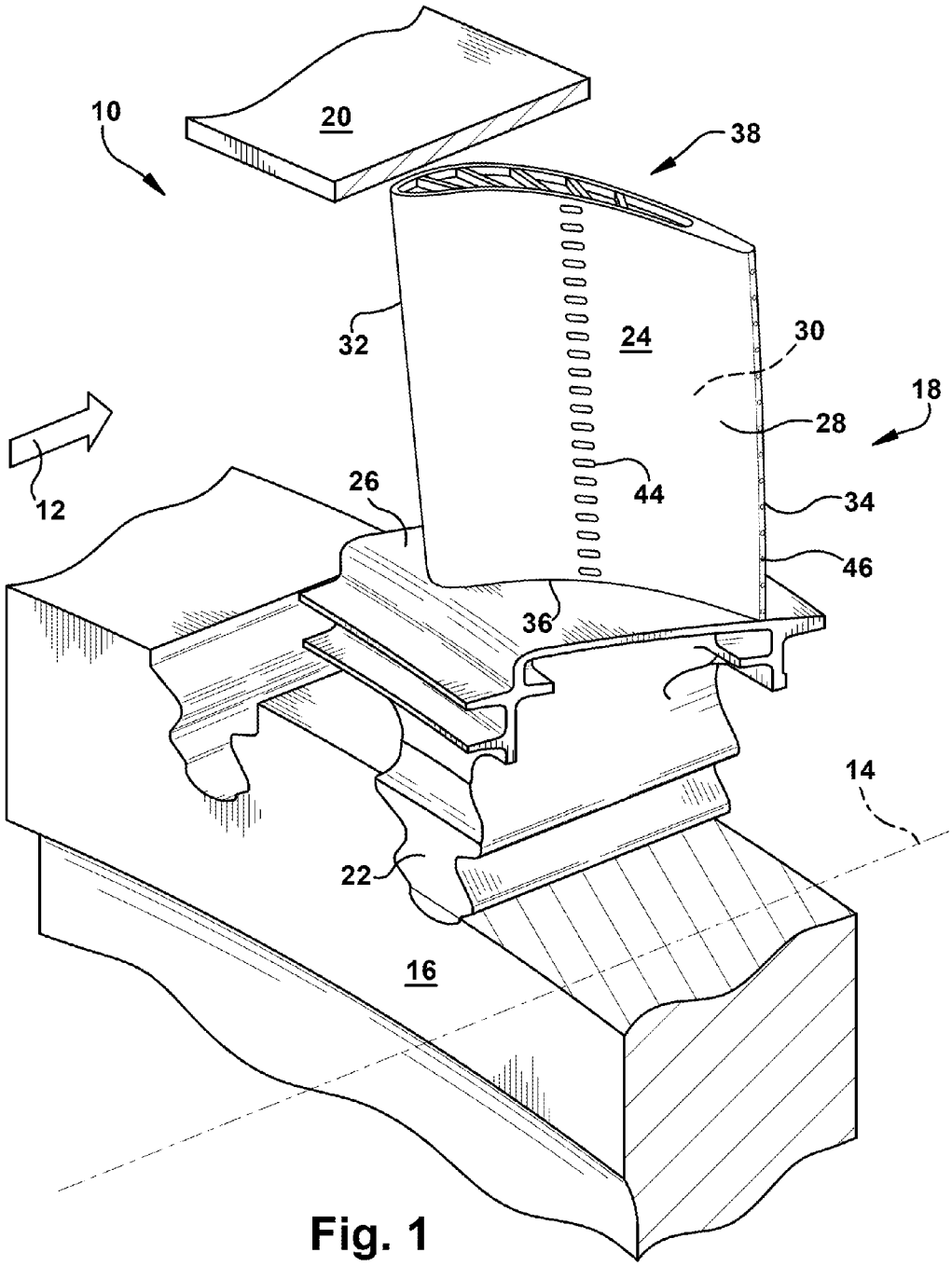
FIG. 1 is a partly sectional, isometric view of an exemplary gas turbine engine rotor blade mounted in a rotor disk within a surrounding shroud, with the blade having a tip in accordance with an exemplary embodiment of the present invention.

Referring now to the drawings, wherein identical numerals indicate the same elements throughout the figures, FIG. 1 depicts a portion of a turbine 10 of a gas turbine engine. The turbine 10 is mounted directly downstream from a combustor (not shown) for receiving hot combustion gases 12 therefrom. The turbine 10, which is axisymmetrical about an axial centerline axis 14, includes a rotor disk 16 and a plurality of circumferentially spaced apart turbine rotor blades 18 (one of which is shown) extending radially outwardly from the rotor disk 16 along a radial axis. An annular turbine shroud 20 is suitably joined to a stationary stator casing (not shown) and surrounds blades 18 for providing a relatively small clearance or gap therebetween for limiting leakage of combustion gases 12 therethrough during operation.

Each blade 18 generally includes a dovetail 22 which may have any conventional form, such as an axial dovetail configured for being mounted in a corresponding dovetail slot in the perimeter of the rotor disk 16. A hollow airfoil 24 is integrally joined to dovetail 22 and extends radially or longitudinally outwardly therefrom. The blade 18 also includes an integral platform 26 disposed at the junction of the airfoil 24 and the dovetail 22 for defining a portion of the radially inner flowpath for combustion gases 12. It will be appreciated that the blade 18 may be formed in any conventional manner, and is typically a one-piece casting.

It will be seen that the airfoil 24 preferably includes a generally concave pressure sidewall 28 and a circumferentially or laterally opposite, generally convex suction sidewall 30 extending axially between opposite leading and trailing edges 32 and 34, respectively. The sidewalls 28 and 30 also extend in the radial direction between a radially inner root 36 at the platform 26 and a radially outer tip or blade tip 38, which will be described in more detail in the discussion related to FIG. 2. Further, the pressure and suction sidewalls 28 and 30 are spaced apart in the circumferential direction over the entire radial span of airfoil 24 to define at least one internal flow chamber or channel for channeling cooling air through the airfoil 24 for the cooling thereof. Cooling air is typically bled from the compressor (not shown) in any conventional manner.

The inside of the airfoil 24 may have any configuration including, for example, serpentine flow channels with various turbulators therein for enhancing cooling air effectiveness, with cooling air being discharged through various holes through airfoil 24 such as conventional film cooling holes 44 and trailing edge discharge holes 46.

Figure 2:
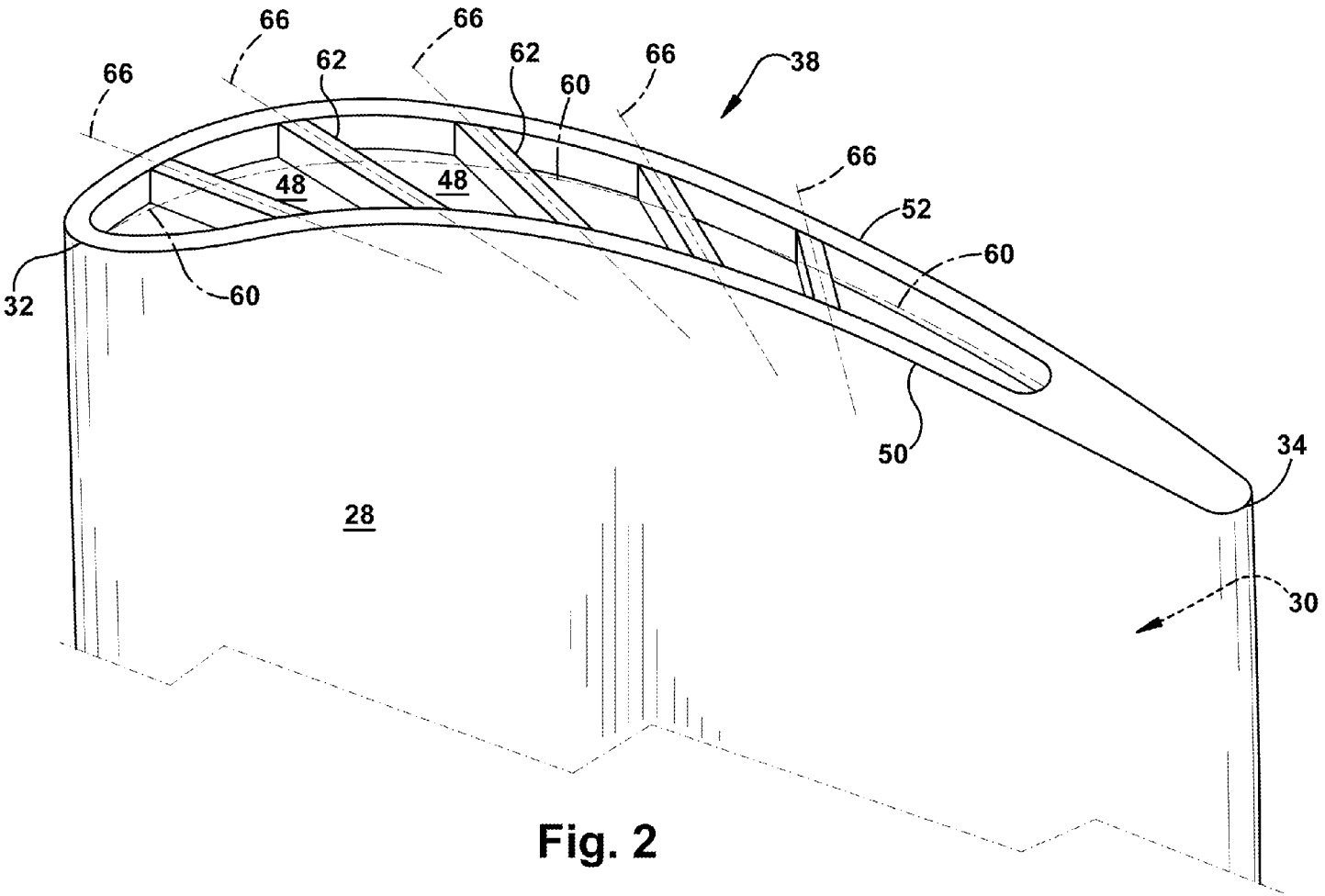
FIG. 2 is an isometric view of the blade tip as illustrated in FIG. 1.

As illustrated in FIG. 2, according to an exemplary embodiment of the present invention, blade tip 38 generally includes a tip plate 48 disposed atop the radially outer ends of the pressure and suction sidewalls 28 and 30, where the tip plate 48 bounds internal cooling channel. The tip plate 48 may be integral to the rotor blade 18 or may be welded into place. A pressure tip wall 50 and a suction tip wall 52 may be formed on the tip plate 48. Generally, the pressure tip wall 50 extends radially outwardly from the tip plate 48 (i.e., forming an angle of approximately 90° with the tip plate 48) and extends from the leading edge 32 to the trailing edge 34. (Note that in some embodiments, the pressure tip wall 50 may form an angle with the tip plate 48 that is between 70° and 110°). The path of pressure tip wall 50 is adjacent to or near the termination of the pressure sidewall 28 (i.e., at or near the periphery of the tip plate 48 along the pressure sidewall 28).

Similarly, the suction tip wall 52 extends radially outwardly from the tip plate 48 (i.e., forming an angle of approximately 90° with the tip plate 48) and extends from the leading edge 32 to the trailing edge 34. (Note that in some embodiments, the suction tip wall 52 may form an angle with the tip plate 48 that is between 70° and 110°). The path of suction tip wall 52 is adjacent to or near the termination of the suction sidewall 30 (i.e., at or near the periphery of the tip plate 48 along the suction sidewall 30).

Consistent with exemplary embodiments of the present invention, the height and width of the pressure tip wall 50 and/or the suction tip wall 52 may be varied depending on best performance and the size of the overall turbine assembly. As one of ordinary skill in the art will appreciate, the height and width of the pressure tip wall 50 and/or the suction tip wall 52 may be described in terms of their relative size in comparison to the radial length of the airfoil 24. In preferred embodiments, the height of the pressure tip wall 50 and/or the suction tip wall 52 may be within the range of between about 0.1% to 10.0% of the radial height of the airfoil 24. (Accordingly, put another way, if "HA" represents the approximate radial height of the airfoil and "HW" represents the approximate radial height of the pressure tip wall 50 or the suction tip wall 52, then the ratio of HW/HA would be a value within the range of about 0.001 to 0.100.) More preferably, the height of the pressure tip wall 50 and/or the suction tip wall 52 may be within the range of between about 1% to 5% of the radial height of the airfoil 24. Additionally, in preferred embodiments, the width of the pressure tip wall 50 and/or the suction tip wall 52 may be within the range of between about 0.1% to 5.0% of the radial height of the airfoil 24. More preferably, the width of the pressure tip wall 50 and/or the suction tip wall 52 may be within the range of between about 0.5% to 2.5% of the radial height of the airfoil 24. In addition, the pressure tip wall 50 and/or the suction tip wall 52 may extend in a continuous or intermittent manner, or may vary in height and width along its path, according to certain alternative embodiments. As shown, the pressure tip wall 50 and/or the suction tip wall 52 may be approximately rectangular in shape; other shapes are also possible.

A tip mid-chord line 60 also is depicted on FIG. 2. As illustrated, the tip mid-chord line 60 is a reference line extending from the leading edge 32 to the trailing edge 34 that connects the approximate midpoints between the pressure tip wall 50 and the suction tip wall 52. According to exemplary embodiments of the present application, one or more tip ribs 62 are formed on the blade tip 38. As used herein, tip ribs 62 comprise narrow elongated protrusions that extend radially from the tip plate 48 (i.e., forming an angle of approximately 90° with the tip plate 48) and traverse across the tip plate 48 from the pressure tip wall 50 to the suction tip wall 52. (Note that in some embodiments, the tip ribs 62 may form an angle with the tip plate 48 that is between 70° and 110°). In some embodiments, the present invention generally provides that the tip ribs 62 be configured such that a longitudinal axis 66 extending through each tip rib 62 forms an angle θ with the tip mid-chord line 60, and that the angle θ fall within the following ranges. Preferably, angle θ is within a range of approximately 60°-120°, more preferably within a range of approximately 70°-110°, and optimally within a range of approximately 80°-100°.

The number of tip ribs 62 may be vary depending upon best performance. In some embodiments, the tip ribs 62 will be approximately evenly spaced from the leading edge 32 to the trailing edge 34. However, best performance may dictate that the spacing of the tip ribs 62 not be regular. The height and width of the tip ribs 62 may be varied depending on best performance and the size of the overall turbine assembly. In preferred embodiments, the height of the tip ribs 62 may be within the range of between about 0.1% to 10% of the radial height of the airfoil 24. More preferably, the height of the tip ribs 62 may be within the range of between about 1.0% to 5% of the radial height of the airfoil 24. In preferred embodiments, the width of the tip ribs 62 may be within the range of between about 0.1% to 5% of the radial height of the airfoil 24. More preferably, the width of the tip ribs 62 may be within the range of between about 0.5% to 2.5% of the radial height of the airfoil 24. The height and width of each tip rib 62 on a particular blade tip 38 may be approximately the same, though they may also vary depending on best performance. In addition, a particular tip rib 62 may be continuous or intermittent as it extends from the pressure tip wall 50 and the suction tip wall 52. A particular tip rib 62 also may vary in height and width along its path, according to certain alternative embodiments and best performance. As shown, the tip ribs 62 may be approximately rectangular in shape; other shapes are also possible, such as a tip rib with rounded edges. In addition, in a preferred embodiment, the tip ribs 62 may extend radially past the height of either the pressure tip wall 50, the suction tip wall 52, or both.

Further, as shown, the tip ribs 62 are straight. In some embodiments (not shown), the tip ribs 62 may be arcuate in shape. In such embodiments, the concave side of the tip rib 62 preferably will be on the upstream side of the rib.

The present invention may be employed with any suitable manufacturing method. The pressure tip wall 50, the suction tip wall 52, and the tip ribs 62 may be formed, for example, by integral casting with the blade tip or complete blade, by electron-beam welding, by physical vapor deposition of material to a blade tip, or by brazing material. The present invention may be made with any suitable material, including the base metal or a dissimilar metallic or ceramic material, such as, for example, abradable TBC.

In use, configurations of the pressure tip wall 50, the suction tip wall 52, and the one or more tip ribs 62, according to the several embodiments discussed above, have been found to inhibit the flow of combustion gases through the gap between the turbine shroud 20 and the blade tip 38 by creating flow resistance therebetween. This, of course, increases the efficiency of the turbine engine because flow that leaks across the blade tip does not exert motive forces on the blade surfaces and accordingly is not providing work to the engine. In addition, it has been found that configurations according to the embodiments of the present invention could enhance the cooling characteristics that conventional systems (which typically include releasing cooling air through cooling holes located on the blade tip 38) provide to the blade tip region. Also, it has been found that configurations according to embodiments of the present invention generally enhance the aerodynamic performance of rotor blades.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

I claim:

1. A turbine rotor blade for a gas turbine engine including an airfoil and dovetail for mounting the airfoil along a radial axis to a rotor disk inboard of a turbine shroud, the airfoil comprising:

a pressure sidewall and a suction sidewall that join together at a leading edge and a trailing edge, the pressure sidewall and suction sidewall extending from a root to a tip plate;

a pressure tip wall that extends radially outwardly from the tip plate, traversing from the leading edge to the trailing edge such that the pressure tip wall resides approximately adjacent to the termination of the pressure sidewall;

a suction tip wall that extends radially outwardly from the tip plate, traversing from the leading edge to the trailing edge such that the suction tip wall resides approximately adjacent to the termination of the suction sidewall; and or more tip ribs that extend substantially between the pressure tip wall and the suction tip wall;

wherein:

a tip mid-chord line comprises a reference line extending from the leading edge to the trailing edge that connects the approximate midpoints between the pressure tip wall and the suction tip wall;

each of the tip ribs are configured such that a longitudinal axis extending through each tip rib forms an angle with the tip mid-chord line; and each of the angles falls within the a range of approximately 80°-100°.

2. The turbine blade according to claim 1, wherein:

the pressure tip wall forms an angle with the tip plate that is between 70° and 110°; and the suction tip wall forms an angle with the tip plate that is between 70° and 110°.

3. The turbine blade according to claim 1, wherein:

"HW" represents at least one of the approximate radial height of the suction tip wall and the approximate radial height of the pressure tip wall;

"HA" represents the approximate radial height of the airfoil; and the ratio of HW/HA comprises a value within the range of about 0.001 to 0.1.

4. The turbine blade according to claim 1, wherein:

"HW" represents at least one of the approximate radial height of the suction tip wall and the approximate radial height of the pressure tip wall;

"HA" represents the approximate radial height of the airfoil; and the ratio of HW/HA comprises a value within the range of about 0.01 to 0.05.

5. The turbine blade according to claim 1, wherein:

"WW" represents at least one of the approximate width of the suction tip wall and the approximate width of the pressure tip wall;

"HA" represents the approximate radial height of the airfoil; and the ratio of WW/HA comprises a value within the range of about 0.001 to 0.05.

6. The turbine blade according to claim 1, wherein:

"WW" represents at least one of the approximate width of the suction tip wall and the approximate width of the pressure tip wall;

"HA" represents the approximate radial height of the airfoil; and the ratio of WW/HA comprises a value within the range of about 0.005 to 0.025.

7. The turbine blade according to claim 1, wherein the pressure tip wall and suction tip wall are continuous between the leading edge to the trailing edge.

8. The turbine blade according to claim 1, wherein each of the tip ribs comprise a narrow elongated protrusions that extends radially from the tip plate and substantially traverse the tip plate from the pressure tip wall to the suction tip wall.

9. The turbine blade according to claim 1, wherein each of the tip ribs forms an angle with the tip plate that is between 70° and 110°.

10. The turbine blade according to claim 1, wherein the tip ribs are approximately evenly spaced from the leading edge to the trailing edge.

11. The turbine blade according to claim 1, wherein the height and width of the tip ribs are approximately equal to the height and width of the pressure tip wall and the suction tip wall.

12. The turbine blade according to claim 1, wherein:

"HR" represents the approximate radial height of the tip ribs;

"HA" represents the approximate radial height of the airfoil; and the ratio of HR/HA comprises a value within the range of about to 0.001 to 0.100.

13. The turbine blade according to claim 1, wherein:

"HR" represents the approximate radial height of the tip ribs;

"HA" represents the approximate radial height of the airfoil; and the ratio of HR/HA comprises a value within the range of about 0.01 to 0.05.

14. The turbine blade according to claim 1, wherein:

"WR" represents at least one of the approximate width of the tip ribs;

"HA" represents the approximate radial height of the airfoil; and the ratio of WR/HA comprises a value within the range of about 0.001 to 0.05.

15. The turbine blade according to claim 1, wherein:

"WR" represents at least one of the approximate width of the tip ribs;

"HA" represents the approximate radial height of the airfoil; and the ratio of WR/HA comprises a value within the range of about 0.005 to 0.025.

16. The turbine blade according to claim 1, wherein each of the tip ribs comprises a continuous rib as from the pressure tip wall and the suction tip wall.

17. The turbine blade according to claim 1, wherein one or more of the tip ribs are arcuate in shape and the concave side of the arcuate tip rib faces toward the leading edge of the rotor blade.

18. The turbine blade according to claim 1, wherein the one or more tip ribs comprise an abradable TBC material.

19. The turbine blade according to claim 1, wherein the one or more tip ribs extend radially past the radial height of one of the pressure tip wall, the suction tip wall, and both.

* * * * *